US006220446B1

(12) United States Patent
Witt et al.

(10) Patent No.: US 6,220,446 B1
(45) Date of Patent: Apr. 24, 2001

(54) PARTICLE SIZE CLASSIFIER

(75) Inventors: Reinhard H. Witt, Wyncote; Robert M. Holland, Jr., Linfield, both of PA (US)

(73) Assignee: PQ Corporation, Berwyn, PA (US)

( * ) Notice: Subject to any disclaimer, the term of this patent is extended or adjusted under 35 U.S.C. 154(b) by 0 days.

(21) Appl. No.: 09/276,178

(22) Filed: Mar. 25, 1999

(51) Int. Cl.[7] ..... B07B 1/22

(52) U.S. Cl. ..... 209/303; 209/240; 209/258; 209/380; 209/643

(58) Field of Search ..... 209/303, 304, 209/361, 380, 240, 258, 259, 643, 664, 672, 683

(56) References Cited

U.S. PATENT DOCUMENTS 1,839,941 * 1/1932 Zelezniak ..... 209/303
3,349,911 * 10/1967 Reddick ..... 209/304
4,310,412 1/1982 Murakami et al. .
4,461,702 * 7/1984 Furukawa ..... 209/303

FOREIGN PATENT DOCUMENTS 1193344 5/1965 (DE) .

OTHER PUBLICATIONS

International Search Report dated Jun. 29, 2000.

* cited by examiner

*Primary Examiner*—John M. Jillions
(74) *Attorney, Agent, or Firm*—Ratner & Prestia

(57) ABSTRACT

A particle size classifier in which feed material composed of product and overs moves downwardly through a separator unit by the action of negative pressures created by a first air blower associated with the collection of product and a second air blower associated with the collection of overs. As the feed material moves downwardly, the product and the overs are separated with the product passing from within a screen unit to outside the screen unit and the screen unit preventing passage of the overs. Blowback air, applied to the screen unit from the outside cleans the cylindrical screen unit to permit continued passage of product through the screen unit.

14 Claims, 5 Drawing Sheets

PARTICLE SIZE CLASSIFIER

TECHNICAL FIELD

The present invention relates, in general, to the handling of materials and, in particular, to the separation of desired powder product (i.e. "fines") from oversized, undesired components (i.e. "overs") in feed material containing both.

BACKGROUND OF THE INVENTION

There are many types of equipment which handle bulk material in which particles of many different sizes are present and which must separate out desired size particles of from undesired, oversized particles. Generally, such equipment that is commercially available for separating out desired size particles fails to meet one or more of the following desired features:

(1) clean product separation, namely a distinct separation of desired size particles from undesired, oversized particles (2) high screening efficiency, namely the separation of large percentages of the desired size particles (3) high throughput capacity (4) relatively dust free surrounding environment (5) minimum material build-up on screens that affects separation, particularly static build up of material in the winter

SUMMARY OF THE INVENTION

A particle size classifier, constructed in accordance with the present invention, includes a housing and means for supplying feed material composed of product and overs. This particle size classifier also includes a vertically disposed separator unit mounted within the housing and which has a cylindrical screen unit through which product passes from within the cylindrical screen unit to space outside the cylindrical screen unit within the housing and within which overs are retained. The separator unit also has a plurality of horizontally disposed perforated circular plates fixed to and within the cylindrical screen unit at spaced intervals along the length of the cylindrical screen unit and through which feed material passes downwardly. A particle size classifier, constructed in accordance with the present invention, further includes a vertically disposed center pipe extending through the plurality of circular plates and to which the plurality of circular plates are fixed. This center pipe has at an upper end means for conducting feed material from the feed material supply means to the center pipe and from within the center pipe to within the cylindrical screen unit and at a lower end means for conducting overs from within the cylindrical screen unit to the center pipe and from within the center pipe to a container for overs. Also included in a particle size classifier constructed in accordance with the present invention is a blowback air unit mounted within the housing spaced from the cylindrical screen unit and extending parallel to the cylindrical screen unit for supplying blowback air into the cylindrical screen unit. This particle size classifier further includes means for imparting rotary movement to the center pipe and means for conducting product from the space outside the cylindrical screen unit within the housing to a container for product.

DETAILED DESCRIPTION OF THE INVENTION

Figure 1:
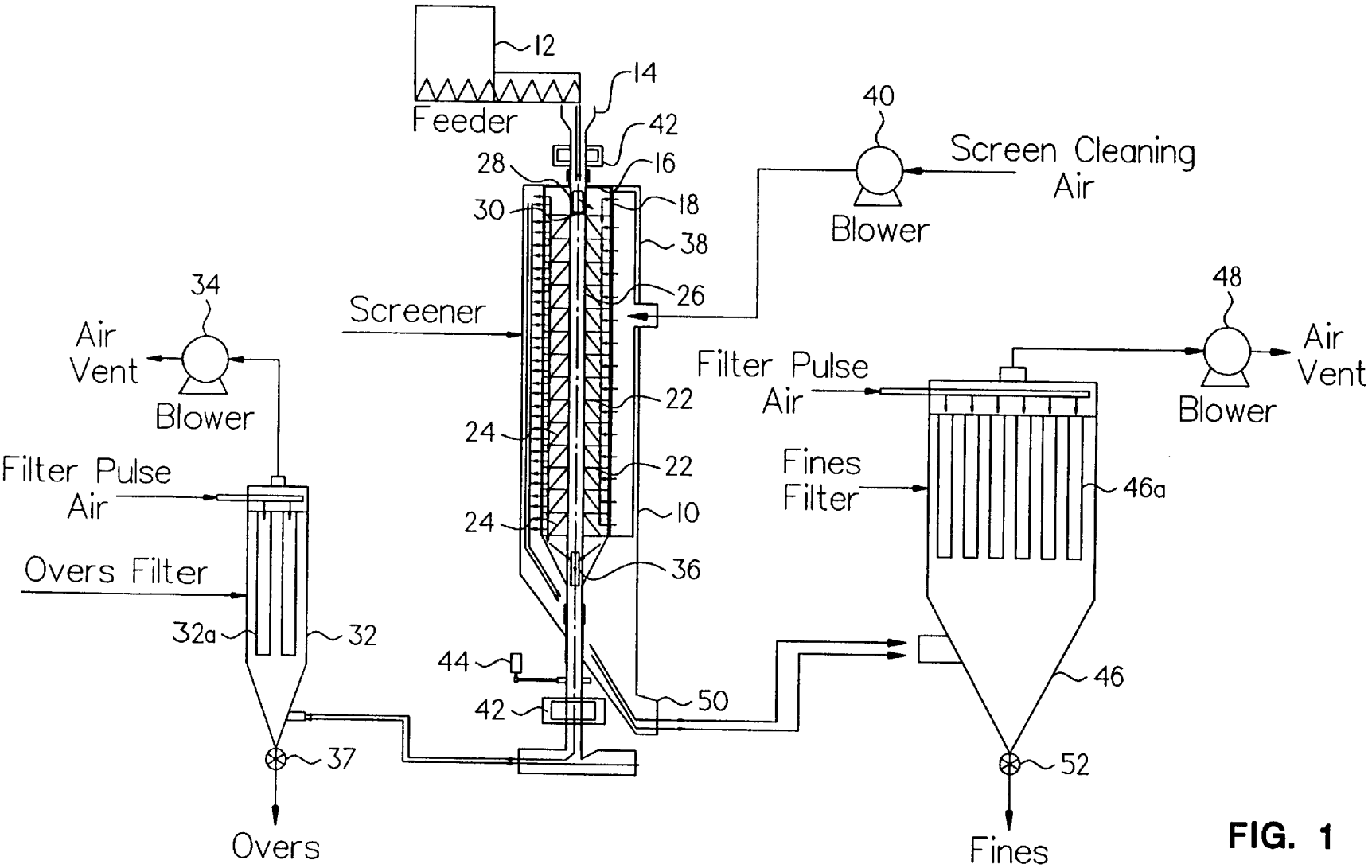
FIG. 1 is vertical schematic view, partially in section, of a particle size classifier constructed in accordance with the present invention.
Figure 2:
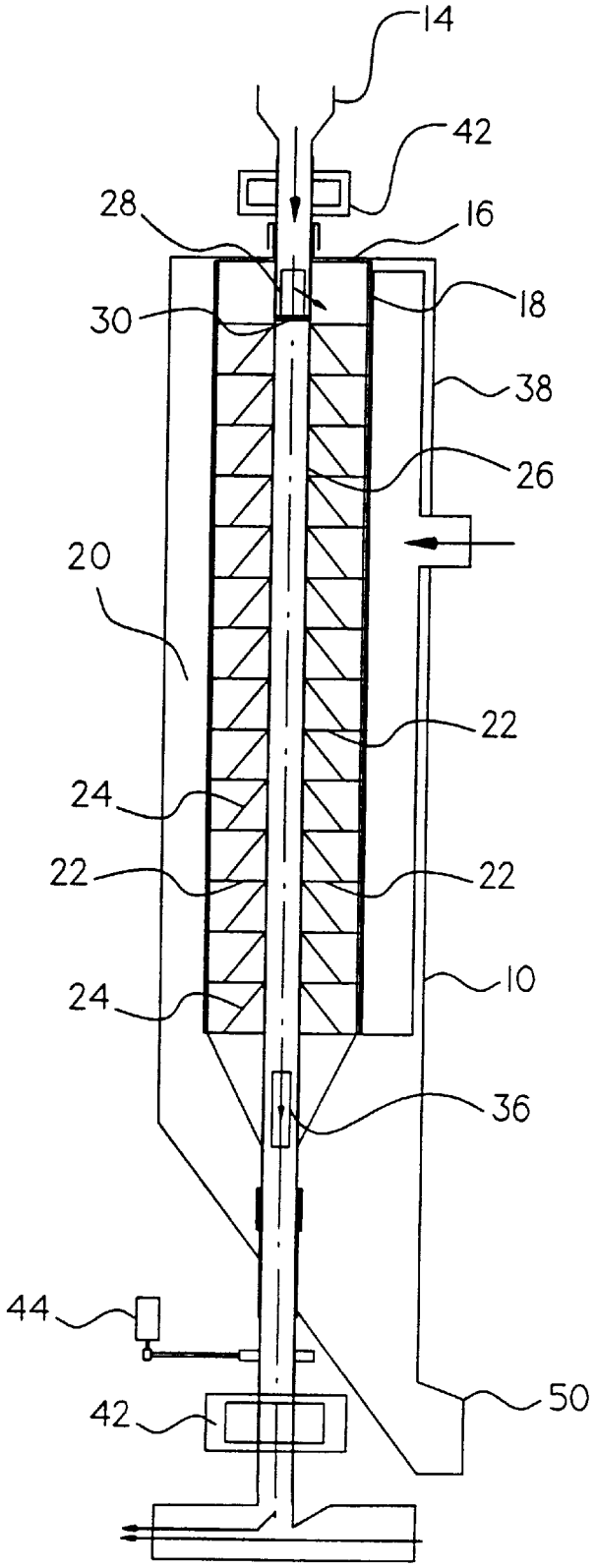
FIG. 2 is a vertical sectional view of a separator unit that is a part of a particle size classifier unit constructed in accordance with the present invention.

Referring to FIGS. 1 and 2, a particle size classifier, constructed in accordance with the present invention, includes a housing 10 and means for supplying feed material composed of product and overs. Such means can be a feeder hopper 12 that contains desired particles (i.e. "product") which are to be separated from other, larger size particles (i.e. "overs") and an inlet funnel 14.

Figure 3:
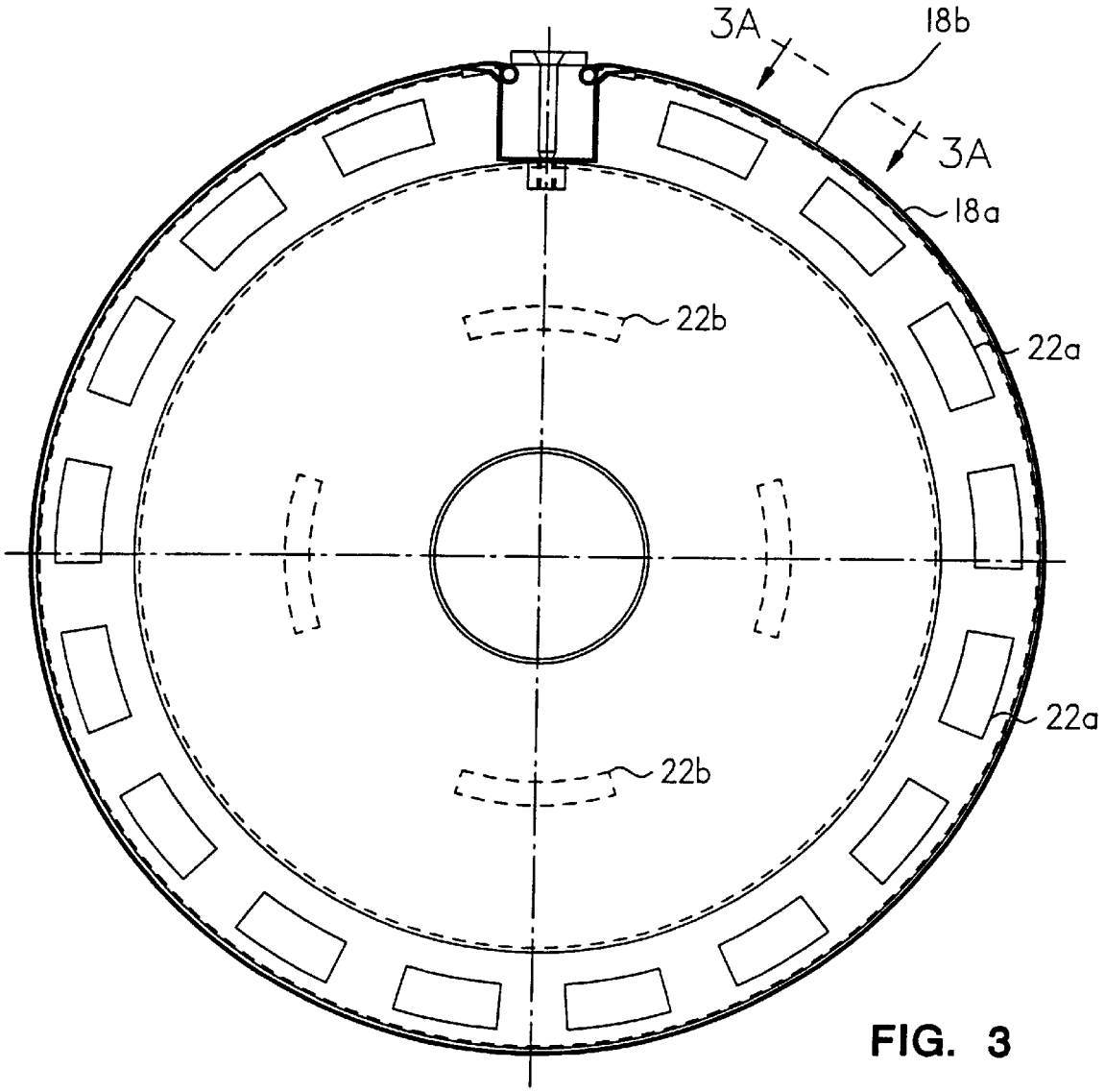
FIG. 3 is a cross-sectional view of a cylindrical screen unit that is a part of a particle size classifier constructed in accordance with the present invention.
Figure 3A:
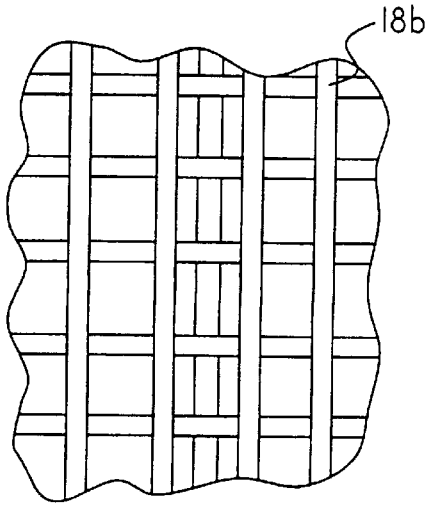
FIG. 3A is a side view of a portion of the FIG. 3 cylindrical screen unit.

A particle size classifier, constructed in accordance with the present invention, also includes a vertically disposed separator unit 16 mounted within housing 10. Separator unit 16 has a cylindrical screen unit 18 through which product passes from within the cylindrical screen unit to space 20 outside the cylindrical screen unit within the housing and within which overs are retained. As shown most clearly in FIGS. 3 and 3A, cylindrical screen unit 18 includes a separation screen 18*a* having a mesh size which permits product to pass from within the cylindrical screen unit to space 20 outside the cylindrical screen unit and prevents overs from passing from within the cylindrical screen unit to the space outside the cylindrical screen unit. For separation of extremely fine product, cylindrical screen unit 18 preferably also includes a support screen 18*b* to which separation screen 18*a* is attached by welding for example. Support screen 18*b* has a mesh size larger than the mesh size of separation screen 18*a*.

Figures 4, 5:
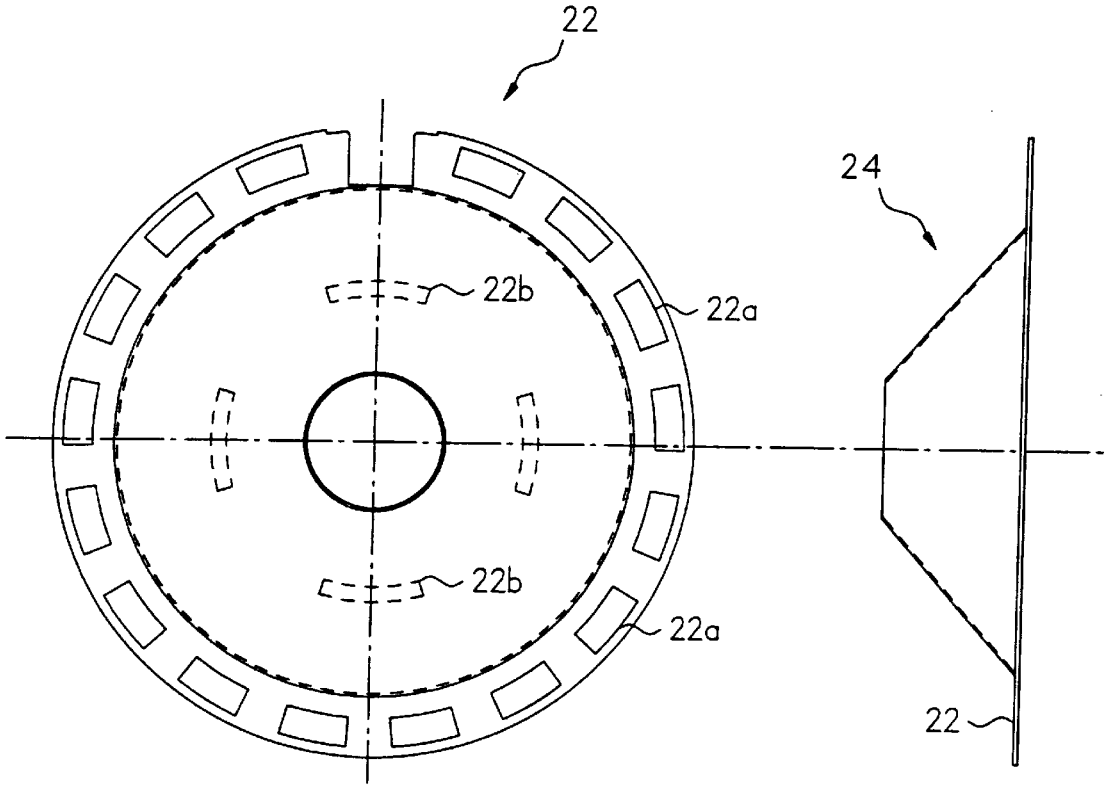
FIG. 4 is a plan view of a circular plate that is a part of a particle size classifier constructed in accordance with the present invention.
FIG. 5 is a side view of a conical member that is part of a particle size classifier constructed in accordance with the present invention.

Separator unit 16 also has a plurality of horizontally disposed perforated circular plates 22 fixed to and within cylindrical screen unit 18 at spaced intervals along the length of the cylindrical screen unit and through which feed material passes downwardly. As shown in FIG. 4, each circular plate 22 has a plurality of openings 22*a* at the periphery thereof through which feed material passes downwardly.

Separator unit 16 further includes a plurality of conical members 24, shown in FIG. 5, each extending from the inner periphery of an upper circular plate 22 downwardly and radially outwardly to the next lower circular plate 22. Each circular plate 22 has a second plurality of openings 22*b* radially inward of a circle at which a conical member 24 meets a circular plate.

A particle size classifier, constructed in accordance with the present invention, further includes a vertically disposed center pipe 26 extending through the plurality of circular plates 22 and to which the plurality of circular plates are fixed. The upper end of center pipe 26 preferably is connected to funnel 14 of the feed material supply means outside housing 10. Center pipe 26 has at an upper end means for conducting feed material from funnel 14 of the feed material supply means to the center pipe and from within the center pipe to within cylindrical screen unit 18. For the embodiment of the invention being described, center pipe 26 is hollow throughout the length thereof and feed material is conducted at the upper end of the center pipe through first and second diametrically opposed openings 28 (only one being shown in FIGS. 1 and 2) in the center pipe at a point within cylindrical screen unit 18 to the cylindrical screen unit. A blank 30 in center pipe 26 below first and second openings 28 blocks downward movement of feed material in the center pipe.

The lower end of center pipe 26 preferably is connected to an overs container 32 outside housing 10. Overs container 32 is in the form of a filter and is known as a "baghouse." Center pipe 26 has at a lower end means for conducting overs from within cylindrical screen unit 18 to the center pipe and from within the center pipe to container 32 for overs. The means for conducting overs to overs container 32 include a first suction source in the form of a blower 34 for drawing overs from within center pipe 26. Overs are conducted at the lower end of center pipe 26 into the center pipe through third and fourth diametrically opposed openings 36 (only one being shown in FIGS. 1 and 2) in the center pipe at a point within cylindrical screen 18. Periodically (e.g. every few seconds), air at a pressure greater than the pressure drawn by blower 34, is injected into baghouse 32 at the top of the baghouse to clean filters 32*a* in the baghouse causing overs caught in the filters to drop to the bottom of the baghouse from where the overs can be removed through a valve 37.

Figure 6A:
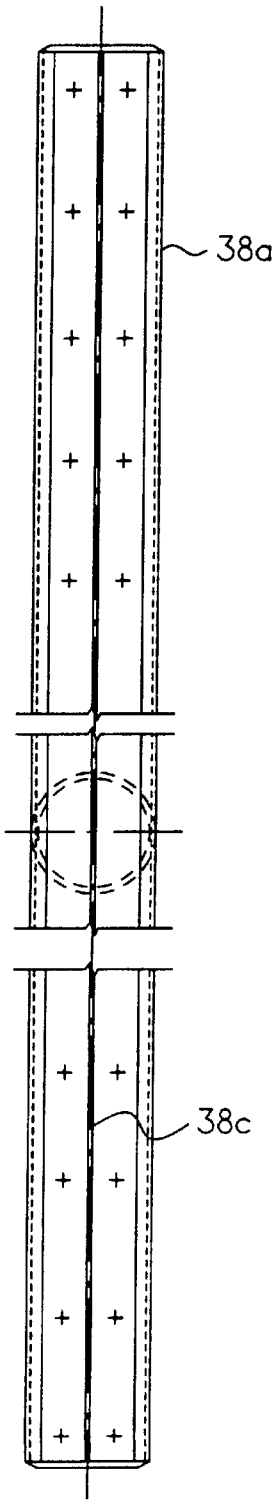
FIG. 6A is a first side view of a blowback air pipe that is a part of a particle size classifier constructed in accordance with the present invention.
Figure 6B:
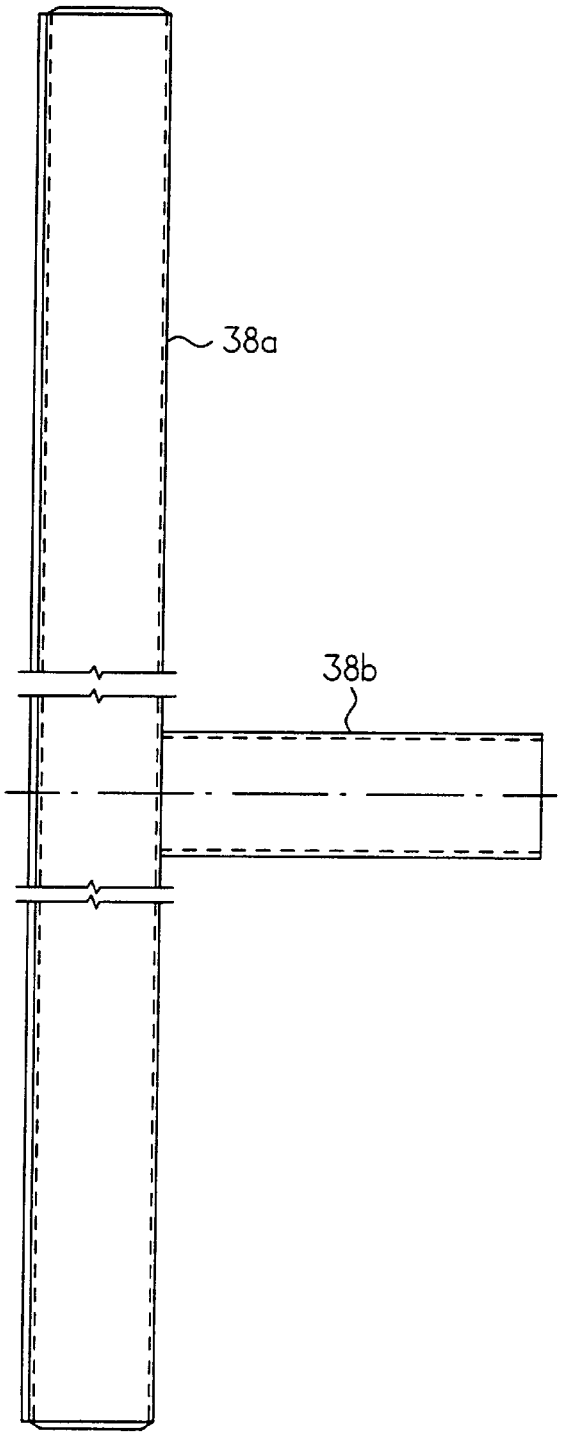
FIG. 6B is a second side view of the FIG. 6A blowback air pipe disposed 90° from the side view of FIG. 6A.

A particle size classifier, constructed in accordance with the present invention, further includes a blowback air unit 38 mounted within housing 10 spaced from cylindrical screen unit 18. Blowback air unit 38 extends parallel to cylindrical screen unit 18 and supplies blowback air into the cylindrical screen unit. As shown in FIGS. 6A and 6B, blowback air unit 38 includes a vertically disposed pipe 38*a* and an inlet channel 38*b*. Pipe 38*a* has a slit 38*c* extending along the length thereof that can be adjustable and through which blowback air, introduced through inlet channel 38*b*, is conducted to cylindrical screen unit 18. Blowback air is supplied from a blower 40.

A particle size classifier, constructed in accordance with the present invention, further includes means for imparting rotary movement to center pipe 26. For the embodiment of the invention being described, such means include a pair of bearings 42 by which center pipe 26 is mounted and a motor 44 coupled to the center pipe. As rotary movement is imparted to center pipe 26, cylindrical screen unit 18 also rotates because the center pipe is attached to circular plates 22 of the cylindrical screen unit.

A particle size classifier, constructed in accordance with the present invention, further includes means for conducting product (i.e. fines) from space 20 outside cylindrical screen unit 18 within housing 10 to a product container 46 (i.e. a "baghouse") in the form of a filter. Such means include a second suction source in the form of a blower 48 for drawing product from space 20 outside cylindrical screen unit 18 within housing 10 through an outlet 50 to baghouse 46. Periodically (e.g. every few seconds), air at a pressure greater than the pressure drawn by blower 48, is injected into baghouse 46 at the top of the baghouse to clean filters 46*a* in the baghouse causing product caught in the filters to drop to the bottom of the baghouse from where the product can be removed through a valve 52.

In operation, feed material composed of product and overs is supplied from feeder hopper 12 through funnel 14 into center pipe 26. The feed material passes through openings 28 in the center pipe into cylindrical screen unit 18. The centrifugal force imparted to the feed material by the rotating conical members 24 causes product and overs to be urged radially outward with some portion of the product passing through cylindrical screen unit 18 to space 20, while overs and the remaining portion of the product do not pass through the cylindrical screen unit. A portion of the product passing into space 20 drops downwardly due to the negative pressure created by blowers 48 and gravity. Blowback air, introduced through blowback air unit 38, cleans cylindrical screen unit 18 of product and overs. The overs and that portion of the product which remains inside cylindrical screen unit 18 or returns to within the cylindrical screen unit by the action of the blowback air are urged radially outward by conical members 24 and fall downwardly through openings 22*a* in circular plates 22 due to the negative pressure created by blower 48 and gravity. Openings 22*b* in circular plates 22 are provided to permit product getting beneath conical members 24 to pass through to the next lower conical member.

Upon reaching the bottom of separator unit 16, product is drawn through outlet 50 to baghouse 46 by the negative pressure created by blower 48 and overs are drawn from center pipe 26 to baghouse 32 by the negative pressure created by blower 34. Product cleaned off filters 46*a* in baghouse 46 is removed from this baghouse through valve 52 and overs cleaned off filters 32*a* in baghouse 32 are removed from this baghouse through valve 37.

While in the foregoing there have been described preferred embodiments of the present invention, it should be understood by those skilled in the art that various modifications and changes can be made without departing from the true spirit and scope of the present invention.

What is claimed:

1. A particle size classifier comprising:

a housing;

means for supplying feed material composed of product and overs;

a vertically disposed separator unit mounted within said housing and having;

(a) cylindrical screen unit:

(1) through which product passes from within said cylindrical screen unit to space outside said cylindrical screen unit within said housing, and (2) within which overs are retained, and (b) a plurality of horizontally disposed perforated circular plates fixed to and within said cylindrical screen unit at spaced intervals along the length of said cylindrical screen unit and through which feed material passes downwardly;

a vertically disposed center pipe extending through said plurality of circular plates and to which said plurality of circular plates are fixed, said center pipe having:

(a) at an upper end means for conducting feed material from said feed material supply means to said center pipe and from within said center pipe to within said cylindrical screen unit, and (b) at a lower end means for conducting overs from within said cylindrical screen unit to said center pipe and from within said center pipe to a container for overs;

a blowback air unit mounted within said housing spaced from said cylindrical screen unit and extending parallel to said cylindrical screen unit for supplying blowback air into said cylindrical screen unit;

means for imparting rotary movement to said center pipe; and means for conducting product from said space outside said cylindrical screen unit within said housing to a container for product.

2. A particle size classifier according to claim 1 wherein:

(a) said means for conducting overs to said overs container include a first suction source for drawing overs from within said center pipe, and (b) said means for conducting product to said product container include a second suction source for drawing product from said space outside said cylindrical screen unit within said housing.

3. A particle size classifier according to claim 2 wherein said cylindrical screen unit includes:

(a) a separation screen having a mesh size which permits product to pass from within said cylindrical screen unit to said space outside said cylindrical screen unit and prevents overs from passing from within said cylindrical screen unit to said space outside said cylindrical screen unit, and (b) a support screen to which said separation screen is attached and having a mesh size larger than said mesh size of said separation screen.

4. A particle size classifier according to claim 2 wherein:

(a) said center pipe is hollow throughout the length thereof, (b) said feed material conducting means at said upper end of said center pipe include first and second diametrically opposed openings in said center pipe within said cylindrical screen unit and a first blank in said center pipe below said first and said second openings which blocks downward movement of feed material in said center pipe, and (c) said overs conducting means at said lower end of said center pipe includes third and fourth diametrically opposed openings in said center pipe within said cylindrical screen unit.

5. A particle size classifier according to claim 3 wherein each of said circular plates has a plurality of openings at the periphery thereof through which feed material passes downwardly.

6. A particle size classifier according to claim 4 wherein each of said circular plates has a plurality of openings at the periphery thereof through which feed material passes downwardly.

7. A particle size classifier according to claim 5 wherein said blowback air unit includes a vertically disposed pipe having a slit extending along the length thereof through which blowback air is conducted to said cylindrical screen unit.

8. A particle size classifier according to claim 6 wherein said blowback air unit includes a vertically disposed pipe having a slit extending along the length thereof through which blowback air is conducted to said cylindrical screen unit.

9. A particle size classifier according to claim 5 wherein said separator unit further includes a plurality of conical members each extending from the inner periphery of an upper circular plate downwardly and radially outwardly to the next lower circular plate.

10. A particle size classifier according to claim 6 wherein said separator unit further includes a plurality of conical members each extending from the inner periphery of an upper circular plate downwardly and radially outwardly to the next lower circular plate.

11. A particle size classifier according to claim 9 wherein each of said circular plates has a second plurality of openings radially inward of a circle at which a conical member meets said circular plate.

12. A particle size classifier according to claim 10 wherein each of said circular plates has a second plurality of openings radially inward of a circle at which a conical member meets said circular plate.

13. A particle size classifier according to claim 11 wherein said upper end of said center pipe is connected to said feed material supply means outside said housing and said lower end of said center pipe is connected to said overs container outside said housing.

14. A particle size classifier according to claim 12 wherein said upper end of said center pipe is connected to said feed material supply means outside said housing and said lower end of said center pipe is connected to said overs container outside said housing.

* * * * *